United States Patent [19]

Becker et al.

[11] Patent Number: 4,827,277

[45] Date of Patent: May 2, 1989

[54] ANTENNA WITH A MAIN REFLECTOR AND A SUBREFLECTOR

[75] Inventors: Klaus Becker, Gerlingen; Gerhard Greving, Untergruppenbach, both of Fed. Rep. of Germany

[73] Assignee: Standard Elektrik Lorenz AG, Stuttgart, Fed. Rep. of Germany

[21] Appl. No.: 894,151

[22] Filed: Aug. 7, 1986

[30] Foreign Application Priority Data

Sep. 18, 1985 [DE] Fed. Rep. of Germany ..... 3533204

[51] Int. Cl.[4] ..... H01Q 19/14

[52] U.S. Cl. ..... 343/781 P; 343/914

[58] Field of Search ..... 343/781 P, 914

[56] References Cited

U.S. PATENT DOCUMENTS

| | | | |
|---|---|---|---|
| 2,695,958 | 11/1954 | Lewis | 343/914 |
| 3,096,519 | 7/1963 | Martin | 343/914 |
| 4,464,666 | 8/1984 | Watanabe et al. | 343/914 |

FOREIGN PATENT DOCUMENTS

| | | | |
|---|---|---|---|
| 3200731 | 7/1983 | Fed. Rep. of Germany | 343/781 P |
| 2540297 | 8/1984 | France | 343/781 P |
| 0200178 | 3/1983 | German Democratic Rep. | 343/781 P |

OTHER PUBLICATIONS

Erukhimovitch et al., "Two-Reflector Antenna", IEE AP Conference, 1978, pp. 205–207.

Aizenberg et al., "Antennas for Radio Communications, Broadcasting and Television", Telecommunications, vol. 24, No. 4, 1970, pp. 29–38.

*Primary Examiner*—William L. Sikes

*Assistant Examiner*—Hoanganh Le

*Attorney, Agent, or Firm*—Christie, Parker & Hale

[57] ABSTRACT

The antenna has a main reflector (1), a subreflector (4*a*, 4*b*, 5*a*, 5*b*), and a feed radiator (2) which are all rotationally symmetric about a common axis (10). In a section in the direction of this axis of symmetry (10), the subreflector has the shape of two curves meeting in the axis of symmetry. Seen from the feed radiator, these curves are concave. Each of the two curves has at least one step (6*a*, 6*b*) for matching the feed radiator to the transmitter or receiver.

3 Claims, 1 Drawing Sheet

ANTENNA WITH A MAIN REFLECTOR AND A SUBREFLECTOR

BACKGROUND OF THE INVENTION

1. Field of the Invention

The present invention relates to an antenna as set forth in the preamble of claim 1. An antenna of this kind is described in an article by Y. A. Erukhimovitch and V. G. Yampolsky, "Two-Reflector Antenna", IEE AP Conference, 1978, pp. 205 and 206. With such antennas, the aperture blocking caused by the subreflector is minimized.

Compared with this prior art antenna, the novel antenna permits the feed radiator to be matched more properly to the transmitter and the receiver. This is possible over a wide frequency range.

BRIEF DESCRIPTION OF THE DRAWINGS

The invention will now be explained, by way of example, with reference to the accompanying drawing, in which.

DESCRIPTION OF THE PREFERRED EMBODIMENT

Figure 1:
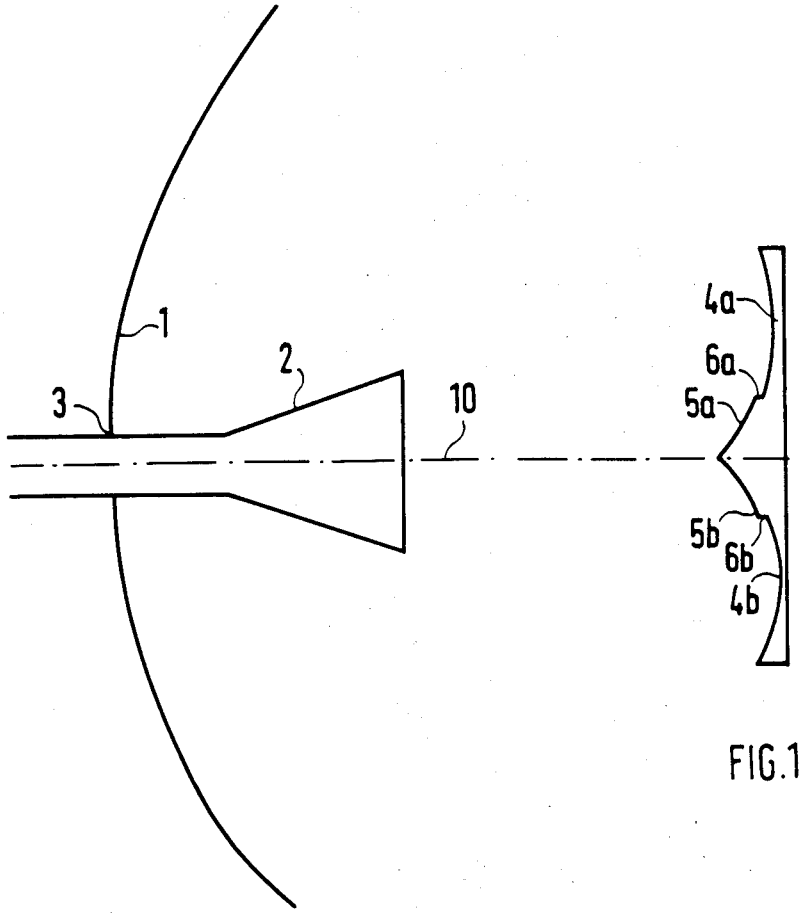
FIG. 1 is a cross section through the antenna.

FIG. 1 shows a cross section through the antenna. The symmetry axis of the antenna is designated 10. Arranged symmetrically about the symmetry axis 10 is a rotationally symmetric main reflector 1 through which extends a feed radiator 2 at the point 3. The feed radiator 2 is connectable to a transmitter or a receiver. Located opposite the feed radiator 2 is a subreflector which is rotationally symmetric about the symmetry axis. In a cross section in the direction of the symmetry axis, the subreflector has the shape of two adjoining curves which have one step each. Seen from the feed radiator 2, the curves have concave surfaces. Leaving the step 6 out of account and assuming that the curve is continuous, i.e., without a step, the curve may be the segment of an ellipse. Both the main reflector 1 and the subreflector are rotationally symmetric about the same symmetry axis 10.

Figure 2:
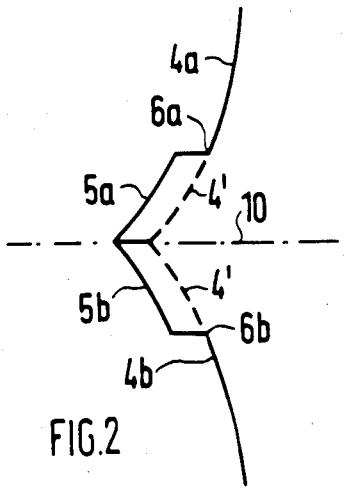
FIG. 2 shows details of FIG. 1.

FIG. 2 shows the cross section through the subreflector in the area of the symmetry axis. In the drawing, the curve portions designated 4*a* and 4*b* are each followed by a curve portion designated 4' (dashed line). This curve, composed of the continuous line and the dashed line, may be a segment of an ellipse, as mentioned above. The actual course of the curves describing the surface of the subreflector in a cross section is obtained by displacing those portions of the curves located between the points 6*a*, 6*b* and the symmetry axis 10 parallel to themselves in the direction of the symmetry axis toward the feed radiator. As a result, each of the curves has a step at the point 6*a*, 6*b*. It is obvious that the electromagnetic waves reflected at the subreflector have different path lengths to the feed radiator 2, depending on whether they are reflected from the subreflector in the areas 4*a* and 4*b* or 5*a* and 5*b*. Electromagnetic waves that reach the feed radiator 2 cannot be reflected from the main reflector 1 in the desired direction and, thus, do not contribute to the useful beam. It must be ensured that these reflected components do not result in any mismatching of the feed radiator to the transmitter or receiver. Therefore, the height of the steps at the points 6*a* and 6*b* is chosen so that the electromagnetic waves reflected from the portions 4*a* or 4*b* and 5*a* or 5*b* of the curves are superimposed one upon another in such a way that the signal at the input 3 of the feed radiator 2 becomes zero as far as possible. The height of the step must be chosen in accordance with the geometry of the overall arrangement. How this is done is familiar to those skilled in the art.

Suitable values for an antenna for 18 GHz are: diameter of the subreflector 4: 80 mm; distance between the point of the subreflector surface where the step is present and the symmetry axis 10: 4 mm; height of the steps at the points 6*a* and 6*b*: 0.6 mm.

Figure 3:
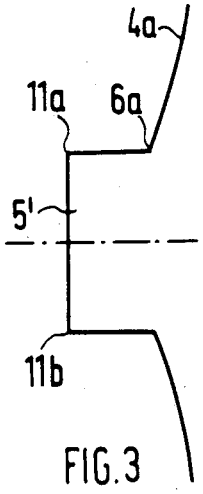
FIGS. 3 and 4 show alternatives to the details of FIG. 2.

In the arrangement of FIG. 2, the portions 5*a* and 5*b* were generated by displacing the portions 4' in the direction of the symmetry axis toward the feed radiator. FIG. 3 shows an alternative solution. In a cross section, the portions 4*a* and 4*b* of the subreflector have the same shape as in FIG. 2; this is a segment of an ellipse, as mentioned above. From the points 6*a* and 6*b*, where the steps begin, to the points 11*a* and 11*b*, the surface of the subreflector is parallel to the symmetry axis. From the points 11*a* and 11*b* to the symmetry axis, the surface is perpendicular to the symmetry axis. In the area of the symmetry axis, the surface of the subreflector thus has a rectangular cross-sectional shape.

Figure 4:
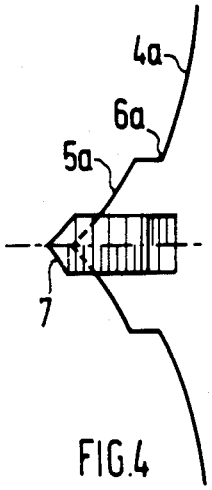

FIG. 4 shows an extension of the arrangement of FIG. 2. Here, the surface of the subreflector is again composed of two elliptic portions 4 and 5. In this arrangement, however, a screw 7 is additionally disposed in the subreflector in the symmetry axis 10. The surface of the screw 7 facing the feed radiator is chosen to be similar in section to the curve 5*a*. The screw has a head diameter of 1.5 mm. By turning the screw in or out, fine adjustment is possible.

The arrangement of FIG. 3, too, can be supplemented with a screw for fine adjustment.

We claim:

1. An antenna with a main reflector, a subreflector, and a feed radiator all having a common axis of symmetry, to form a rotationally symmetric subreflector, in a cross section in the direction of the axis of symmetry, having the shape of two curves which meet in said axis of symmetry and, from the direction of the feed radiator, are concave, wherein said two curves contain at least one step each, and such that the height of said step is selected so that the fractions of radiation reflected from the subreflector back to the feed radiator are superimposed one upon another so as to substantially cancel out the input of the feed radiator over a wide range of frequencies, said step being located from said axis of symmetry by about 1/10 the diameter of the subreflector.

2. An antenna as claimed in claim 1, wherein the curves between the steps and the axis of symmetry, which describe a cross section, are generated by displacing the corresponding curve portions that would be present without the steps parallel to themselves in the direction of the axis of symmetry between the points at which the steps are present later and the axis of symmetry.

3. An antenna as claimed in claim 2, wherein for fine adjustment, a screw is so disposed centrally in the stepped central portion of the subreflector such that the distance between the surface of the screw at which the radiation from the feed radiator is reflected and the feed radiator can be varied.

* * * * *